US007871246B2

(12) United States Patent
Liang

(10) Patent No.: US 7,871,246 B2
(45) Date of Patent: Jan. 18, 2011

(54) AIRFOIL FOR A GAS TURBINE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 388 days.

(21) Appl. No.: 11/707,192

(22) Filed: Feb. 15, 2007

(65) Prior Publication Data

US 2009/0324385 A1 Dec. 31, 2009

(51) Int. Cl.
*F01D 5/08* (2006.01)

(52) U.S. Cl. ..... 416/97 R

(58) Field of Classification Search ..... 415/115; 416/97 R, 96 R, 90 R
See application file for complete search history.

(56) References Cited

U.S. PATENT DOCUMENTS 4,056,332 A * 11/1977 Meloni ..... 416/97 A
4,218,179 A * 8/1980 Barry et al. ..... 415/114
5,120,192 A * 6/1992 Ohtomo et al. ..... 415/115
5,328,331 A * 7/1994 Bunker et al. ..... 416/96 R
5,484,258 A 1/1996 Isburgh et al.
5,516,260 A * 5/1996 Damlis et al. ..... 415/115
5,762,471 A 6/1998 Cunha
6,478,535 B1 11/2002 Chung et al.
6,511,293 B2 * 1/2003 Widrig et al. ..... 416/96 R
6,533,547 B2 * 3/2003 Anding et al. ..... 416/97 R
6,916,150 B2 * 7/2005 Liang ..... 415/115
6,981,846 B2 * 1/2006 Liang ..... 416/97 R
7,029,235 B2 * 4/2006 Liang ..... 416/92
7,059,825 B2 6/2006 Magowan et al.
7,104,757 B2 9/2006 Gross
7,497,655 B1 * 3/2009 Liang ..... 415/1
2002/0150474 A1 10/2002 Balkcum, III et al.
2003/0133799 A1 * 7/2003 Widrig et al. ..... 416/97 R
2004/0009066 A1 * 1/2004 Soechting et al. ..... 416/96 R
2005/0031452 A1 * 2/2005 Liang ..... 416/97 R
2005/0095118 A1 5/2005 Liang
2005/0095119 A1 5/2005 Liang
2005/0244270 A1 * 11/2005 Liang ..... 416/97 R
2005/0265837 A1 * 12/2005 Liang ..... 416/97 R
2005/0265838 A1 12/2005 Liang
2005/0281667 A1 * 12/2005 Liang ..... 415/115
2005/0281671 A1 12/2005 Liang (Continued)

FOREIGN PATENT DOCUMENTS

EP 0182588 A1 5/1986

(Continued)

*Primary Examiner*—Edward Look
*Assistant Examiner*—Aaron R Eastman

(57) ABSTRACT

An airfoil is provided for a gas turbine comprising an outer structure comprising a first wall, an inner structure comprising a second wall spaced relative to the first wall such that a cooling gap is defined between at least portions of the first and second walls, and seal structure provided within the cooling gap between the first and second walls for separating the cooling gap into first and second cooling fluid impingement gaps. An inner surface of the second wall may define an inner cavity. The inner structure may further comprise a separating member for separating the inner cavity of the inner structure into a cooling fluid supply cavity and a cooling fluid collector cavity. The second wall may comprise at least one first impingement passage, at least one second impingement passage, and at least one bleed passage.

20 Claims, 6 Drawing Sheets

U.S. PATENT DOCUMENTS

| | | | | |
|---|---|---|---|---|
| 2006/0002788 | A1 | 1/2006 | Liang | |
| 2006/0056967 | A1 | 3/2006 | Liang | |
| 2006/0153679 | A1 | 7/2006 | Liang | |
| 2006/0222494 | A1* | 10/2006 | Liang | 416/97 R |
| 2007/0128031 | A1* | 6/2007 | Liang | 416/97 R |
| 2007/0280832 | A1* | 12/2007 | Liang | 416/97 R |
| 2008/0019840 | A1* | 1/2008 | Cunha | 416/96 R |
| 2008/0226462 | A1* | 9/2008 | Albert et al. | 416/97 R |
| 2008/0279696 | A1* | 11/2008 | Liang | 416/97 R |
| 2008/0279697 | A1* | 11/2008 | Liang | 416/97 R |
| 2009/0104042 | A1* | 4/2009 | Liang | 416/97 R |
| 2009/0208343 | A1* | 8/2009 | Cunha | 416/97 R |
| 2009/0324421 | A1* | 12/2009 | Ahmad et al. | 416/96 R |

FOREIGN PATENT DOCUMENTS

| | | | |
|---|---|---|---|
| EP | 0392664 | A2 | 10/1990 |
| GB | 2112869 | A * | 7/1983 |

* cited by examiner

AIRFOIL FOR A GAS TURBINE

This invention was made with U.S. Government support under Contract Number DE-FC26-05NT42644 awarded by the U.S. Department of Energy. The U.S. Government has certain rights to this invention.

FIELD OF THE INVENTION

The present invention relates to an airfoil for a turbine of a gas turbine engine and, more preferably, to an airfoil having an improved cooling system.

BACKGROUND OF THE INVENTION

A conventional combustible gas turbine engine includes a compressor, a combustor, and a turbine. The compressor compresses ambient air. The combustor combines the compressed air with a fuel and ignites the mixture creating combustion products defining a working gas. The working gas travels to the turbine. Within the turbine are a series of rows of stationary vanes and rotating blades. Each pair of rows of vanes and blades is called a stage. Typically, there are four stages in a turbine. The rotating blades are coupled to a shaft and disc assembly. As the working gas expands through the turbine, the working gas causes the blades, and therefore the shaft and disc assembly, to rotate.

Combustors often operate at high temperatures that may exceed 2,500 degrees Fahrenheit. Typical combustor configurations expose turbine vanes and blades to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine blades comprise a root, a platform and an elongated portion forming a blade that extends outwardly from the platform. The blade is ordinarily composed of a tip opposite the root, a leading edge or end, and a trailing edge or end. Most turbine blades typically contain internal cooling channels forming a cooling system. The cooling channels in the blades may receive air from the compressor of the turbine engine and pass the air through the blade. The cooling channels often include multiple flow paths that are designed to maintain the turbine blade at a relatively uniform temperature.

Conventional turbine blades have many different designs of internal cooling systems. While many of these conventional systems have operated successfully, the cooling demands of turbine engines produced today have increased. Thus, an internal cooling system for turbine blades as well as vanes having increased cooling capabilities is needed.

SUMMARY OF THE INVENTION

In accordance with a first aspect of the present invention, an airfoil is provided for a gas turbine comprising an outer structure comprising a first wall, an inner structure comprising a second wall spaced relative to the first wall such that a cooling gap is defined between at least portions of the first and second walls, and seal structure provided within the cooling gap between the first and second walls for separating the cooling gap into first and second cooling fluid impingement gaps. An inner surface of the second wall may define an inner cavity. The inner structure may further comprise a separating member for separating the inner cavity of the inner structure into a cooling fluid supply cavity and a cooling fluid collector cavity. The second wall may comprise at least one first impingement passage, at least one second impingement passage, and at least one bleed passage. The at least one first impingement passage may extend from the cooling fluid supply cavity to the first cooling fluid impingement gap, the at least one bleed passage may extend from the first cooling fluid impingement gap to the cooling fluid collector cavity, and the at least one second impingement passage may extend from the cooling fluid collector cavity to the second cooling fluid impingement gap.

The cooling fluid supply cavity is adapted to receive cooling fluid such that the cooling fluid passes from the cooling fluid supply cavity through the at least one first impingement passage into the first cooling fluid impingement gap so as to strike a first section of an inner surface of the first wall. The cooling fluid preferably passes from the first cooling fluid impingement gap through the at least one bleed passage into the cooling fluid collector cavity, and the cooling fluid preferably passes from the cooling fluid collector cavity through the at least one second impingement passage into the second cooling fluid impingement gap so as to strike a second section of the inner surface of the first wall.

The separating member may comprise a first separating member and the cooling fluid collector cavity may comprise a first cooling fluid collector cavity. The inner structure may further comprise a second separating member such that the first and second separating members separate the inner cavity of the inner structure into the cooling fluid supply cavity, the first cooling fluid collector cavity and a second cooling fluid collector cavity.

The seal structure may comprise first seal structure, the at least one bleed passage may comprise at least one first bleed passage and the second wall of the inner structure may further comprise at least one third impingement passage and at least one second bleed passage.

The seal structure may further comprise second seal structure within the cooling gap between the first and second walls such that the first and second seal structures separate the cooling gap into first, second and third cooling fluid impingement gaps. The at least one second bleed passage may extend between the second cooling fluid impingement gap to the second cooling fluid collector cavity and the at least one third impingement passage may extend from the second cooling fluid collector cavity to the third cooling fluid impingement gap.

A first distance between the first and second walls within first cooling fluid impingement gap may differ from a second distance between the first and second walls within the second cooling fluid impingement gap.

The at least one first impingement passage may comprise a plurality of first impingement bores or at least one first impingement slot and the at least one second impingement passage may comprise a plurality of second impingement bores or at least one second impingement slot.

The airfoil may further comprise a plurality of connectors extending between the first and second walls for coupling the first and second walls together.

An inner surface of the first wall of the outer structure may comprise a rough surface.

The outer structure may have first and second end sections, and the first wall may comprise first and second end edges. The second end edge of the first wall may define the second end section of the outer structure and the first end edge of the first wall may be positioned between the first and second end sections of the outer structure.

The inner structure may have first and second end sections. At least one first exit passage may be defined at least in part by the first end edge of the first wall and the second end section of the inner structure. At least one second exit passage may be defined at least in part by the second end edge of the first wall and the second end section of the inner structure.

The at least one first exit passage may comprise a plurality of first exit bores or at least one first exit slot and the at least one second exit passage may comprise a plurality of second exit bores or at least one second exit slot.

The second end section of the inner structure may be solid and comprise at least one impingement passage extending through the inner structure second end section and positioned near the at least one first exit passage.

In accordance with a second aspect of the present invention, a blade for a gas turbine is provided comprising a root; a platform coupled to the root; and an airfoil coupled to the platform. The airfoil may comprise an outer structure comprising a first wall, an inner structure comprising a second wall spaced relative to the first wall such that a cooling gap is defined between at least portions of the first and second walls, and seal structure provided within the cooling gap between the first and second walls for separating the cooling gap into first and second cooling fluid impingement gaps. An inner surface of the second wall may define an inner cavity. The inner structure may further comprise a separating member for separating the inner cavity of the inner structure into a cooling fluid supply cavity and a cooling fluid collector cavity. The second wall may comprise at least one first impingement passage, at least one second impingement passage, and at least one bleed passage. The at least one first impingement passage may extend from the cooling fluid supply cavity to the first cooling fluid impingement gap, the at least one bleed passage may extend from the first cooling fluid impingement gap to the cooling fluid collector cavity, and the at least one second impingement passage may extend from the cooling fluid collector cavity to the second cooling fluid impingement gap.

DETAILED DESCRIPTION OF THE INVENTION

Figure 1:
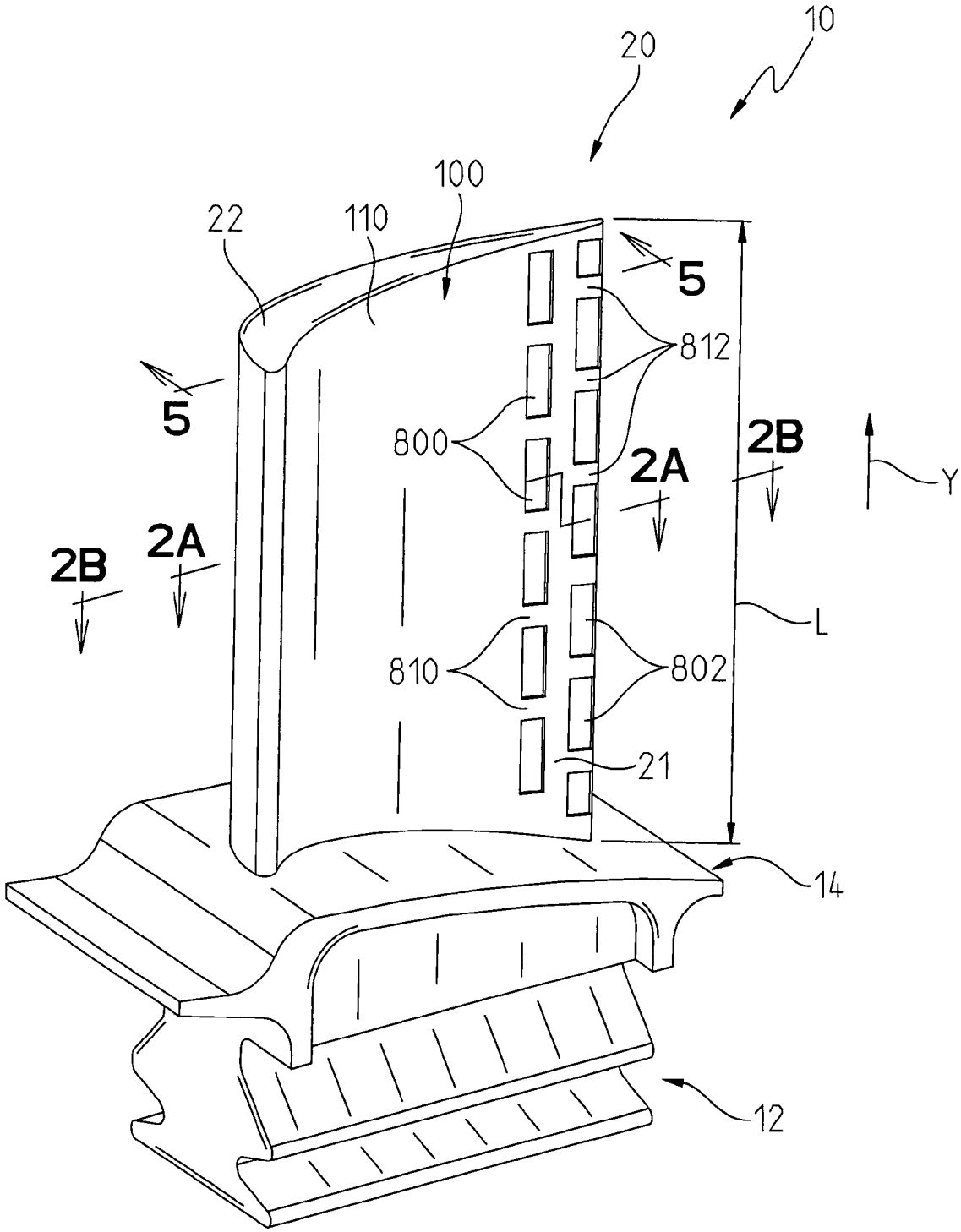
FIG. 1 is a perspective view of a gas turbine blade constructed in accordance with the present invention.

Referring now to FIG. 1, a blade 10 constructed in accordance with the present invention is illustrated. The blade 10 is adapted to be used in a gas turbine (not shown) of a gas turbine engine (not shown). Within the gas turbine are a series of rows of stationary vanes and rotating blades. Typically, there are four rows of blades in a gas turbine. Due to its thin configuration, it is contemplated that the blade 10 illustrated in FIG. 1 may define the blade configuration for a third row of blades in the gas turbine.

The blades are coupled to a shaft and disc assembly. Hot working gases from a combustor (not shown) in the gas turbine engine travel to the rows of blades. As the working gases expand through the turbine, the working gases cause the blades, and therefore the shaft and disc assembly, to rotate.

Figure 4A:
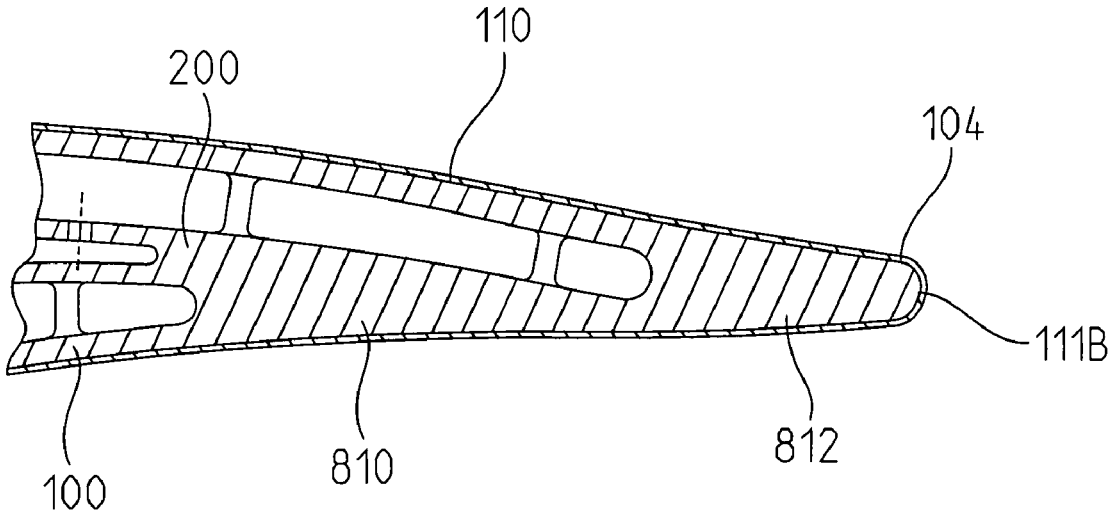
FIG. 4A is cross sectional view taken along view line 4A-4A in FIG. 4.
Figure 4:
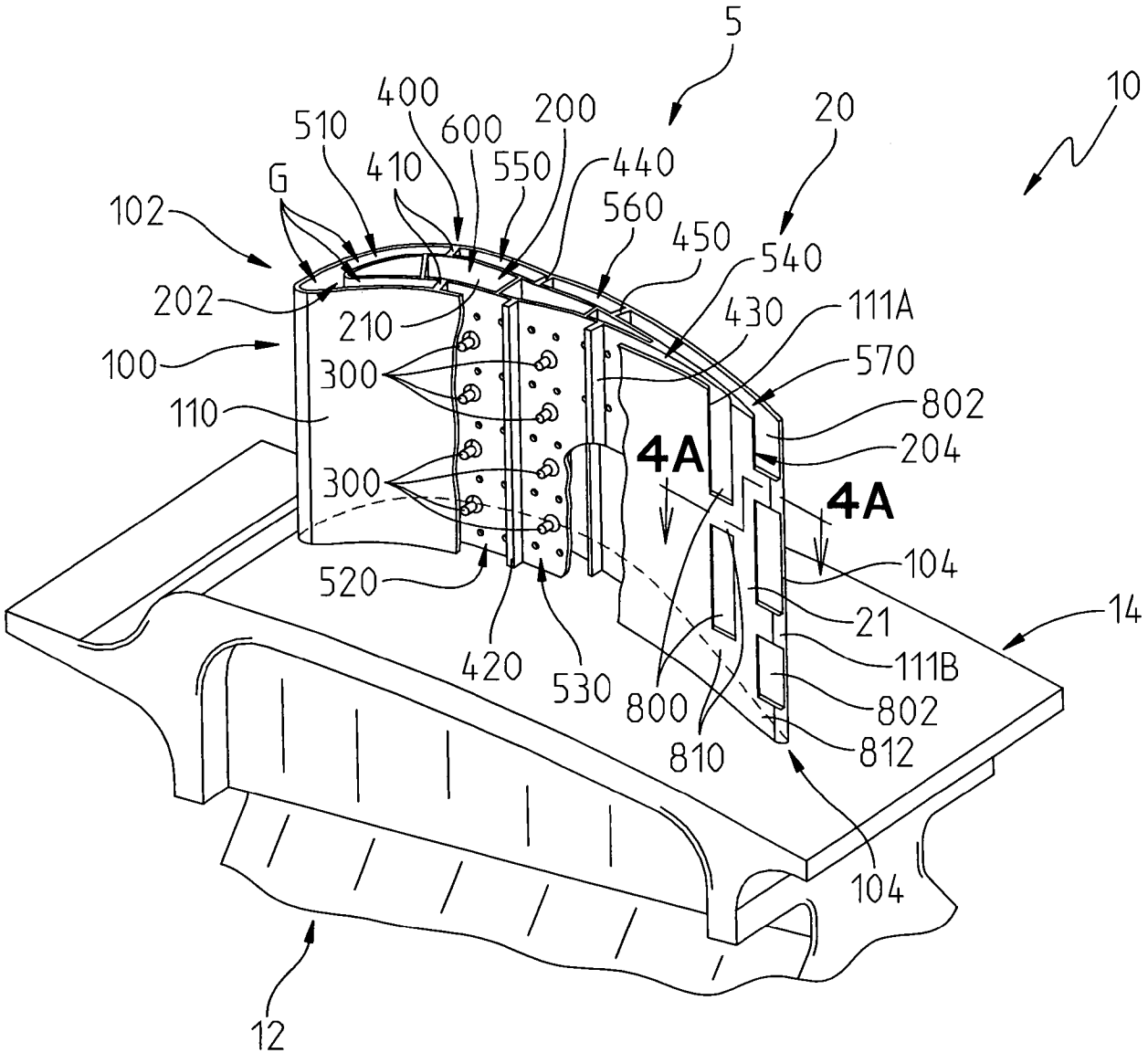
FIG. 4 is a view partially shown in section and with portions removed of the blade shown in FIG. 1.
Figure 5:
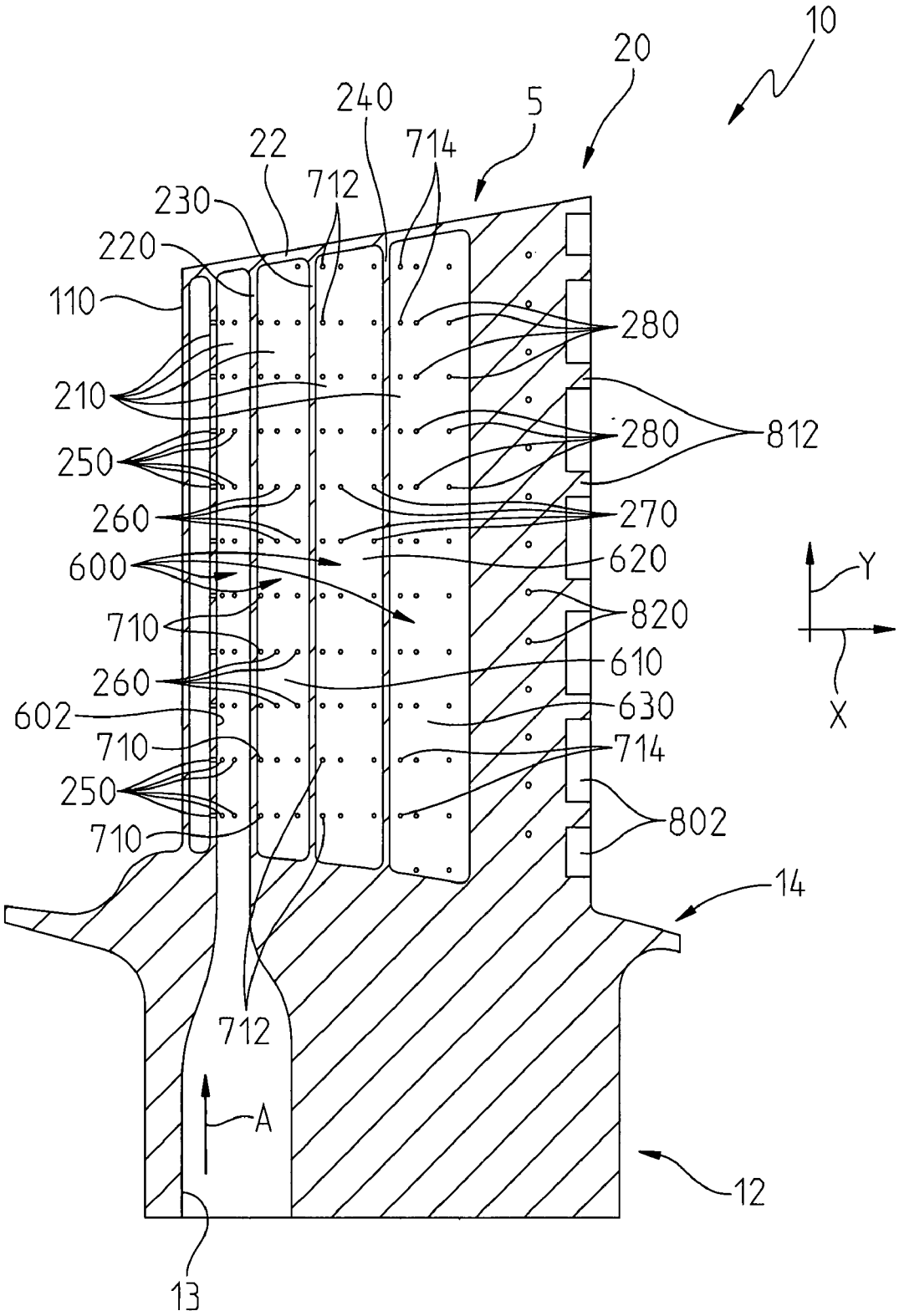
FIG. 5 is a cross sectional view taken along view line 5-5 in FIG. 1.

The blade 10 comprises a root 12, a platform 14 formed integral with the root 12 and an airfoil 20 formed integral with the platform 14, see FIGS. 1, 4 and 5. The root 12 functions to couple the blade 10 to the shaft and disc assembly (not shown) in the gas turbine (not shown).

The airfoil 20 comprises an outer structure 100 comprising a first wall 110, an inner structure 200 comprising a second wall 210, and a tip or end cover 22, see FIGS. 1, 2A, 4 and 5. The second wall 210 is spaced away from the first wall 110 such that a cooling gap G is provided between the first and second walls 110 and 210. A plurality of connectors 300, having a cylindrical shape in the illustrated embodiment, extend between the first and second walls 110 and 210 for coupling the first and second walls 110 and 210 together, see FIGS. 2B and 4. A conventional thermal barrier coating 24 is provided on an outer surface 21 of the first wall 110, see FIGS. 2A and 3.

Seal structure 400 is provided within the cooling gap G between the first and second walls 110 and 210 for separating the cooling gap G into a plurality of cooling fluid impingement gaps. In the illustrated embodiment, the seal structure 400 comprises a pair of first seal walls 410, a second seal wall 420, a third seal wall 430, a fourth seal wall 440 and a fifth seal wall 450, see FIGS. 2A and 4. Each of the first, second, third, fourth and fifth seal walls 410, 420, 430, 440 and 450 extends in a Y-direction along the entire length L of the airfoil 20 from the root 12 to the tip 22, see FIGS. 1 and 4. The first, second, third, fourth and fifth seal walls 410, 420, 430, 440 and 450 separate the cooling gap G into a first cooling fluid impingement gap 510, a second cooling fluid impingement gap 520, a third cooling fluid impingement gap 530, a fourth cooling fluid impingement gap 540, a fifth cooling fluid impingement gap 550, a sixth cooling fluid supply gap 560 and a seventh cooling fluid supply gap 570, see FIGS. 2A and 4.

An inner surface 212 of the second wall 210 may define an inner cavity 600. The inner structure 200 may further comprise first, second and third separating members 220, 230 and 240, respectively, for separating the inner cavity 600 into a cooling fluid supply cavity 602, and first, second and third cooling fluid collector cavities 610, 620 and 630, respectively, see FIGS. 2A and 5. The first, second and third separating members 220, 230 and 240 preferably extend in the Y-direction along the entire length L of the airfoil 20 from the root 12 to the tip 22, see FIGS. 1 and 5. A cooling fluid, such as air or steam, is supplied under pressure to the cooling fluid supply cavity 602 in the direction of arrow A, see FIG. 5, via a cooling fluid supply channel 13 in the root 12 and the platform 14. The cooling fluid supplied to the supply channel 13 may be provided by the combustor (not shown) of the gas turbine engine.

The first and second walls 110 and 210, the connectors 300, the seal walls 410, 420, 430, 440 and 450 and the separating members 220, 230 and 240 may be formed as a single integral unit from a material such as a metal alloy 247 via a conventional casting operation.

A plurality of first impingement passages, bores 250 in the illustrated embodiment, extend through the second wall 210 so as to allow the cooling fluid to pass from the cooling fluid supply cavity 602 into the first cooling fluid impingement gap 510. In particular, jets of cooling fluid pass through the bores 250 and impinge upon a first section 111A of an inner surface 111 of the first wall 110 so as to effect cooling of a first portion 110A of the first wall 110 via convective heat transfer. In the illustrated embodiment, the first impingement bores 250 are spaced apart from one another in a Y direction, and define a plurality of rows extending in the Y direction, see FIGS. 2B and 5. The rows extend along a substantial portion of the length L of the airfoil 20 in the illustrated embodiment.

A plurality of first bleed passages, bores 710 in the illustrated embodiment, extend through the second wall 210 so as to allow the cooling fluid to pass from the first cooling fluid impingement gap 510 into the first cooling fluid collector cavity 610. In the illustrated embodiment, the first bleed bores 710 define a plurality of rows extending in the Y direction and along a substantial portion of the length L of the airfoil 20, see FIGS. 2B and 5.

A plurality of second impingement passages, bores 260 in the illustrated embodiment, extend through the second wall 210 so as to allow the cooling fluid to pass from the first cooling fluid collector cavity 610 into the second and fifth cooling fluid impingement gaps 520 and 550. In particular, jets of cooling fluid pass through the bores 260 and impinge upon second and fifth sections 111B and 111E of the inner surface 111 of the first wall 110 so as to effect cooling of second and fifth portions 110B and 110E of the first wall 110 via convective heat transfer. In the illustrated embodiment, the second impingement bores 260 define a plurality of rows extending in the Y direction and along a substantial portion of the length L of the airfoil 20, see FIGS. 2B and 5.

A plurality of second bleed passages, bores 712 in the illustrated embodiment, extend through the second wall 210 so as to allow the cooling fluid to pass from the second and fifth cooling fluid impingement gaps 520 and 550 into the second cooling fluid collector cavity 620. In the illustrated embodiment, the second bleed bores 712 define a plurality of rows extending in the Y direction and along a substantial portion of the length L of the airfoil 20, see FIGS. 2B and 5.

A plurality of third impingement passages, bores 270 in the illustrated embodiment, extend through the second wall 210 so as to allow the cooling fluid to pass from the second cooling fluid collector cavity 620 into the third and sixth cooling fluid impingement gaps 530 and 560. In particular, jets of cooling fluid pass through the bores 270 and impinge upon third and sixth sections 111C and 111F of the inner surface 111 of the first wall 110 so as to effect cooling of third and sixth portions 110C and 110F of the first wall 110 via convective heat transfer. In the illustrated embodiment, the third impingement bores 270 define a plurality of rows extending in the Y direction and along a substantial portion of the length L of the airfoil 20, see FIGS. 2B and 5.

A plurality of third bleed passages, bores 714 in the illustrated embodiment, extend through the second wall 210 so as to allow the cooling fluid to pass from the third and sixth cooling fluid impingement gaps 530 and 560 into the third cooling fluid collector cavity 630. In the illustrated embodiment, the third bleed bores 714 define a plurality of rows extending in the Y direction and along a substantial portion of the length L of the airfoil 20, see FIGS. 2B and 5.

A plurality of fourth impingement passages, bores 280 in the illustrated embodiment, extend through the second wall 210 so as to allow the cooling fluid to pass from the third cooling fluid collector cavity 630 into the fourth and seventh cooling fluid impingement gaps 540 and 570. In particular, jets of cooling fluid pass through the bores 280 and impinge upon fourth and seventh sections 111D and 111G of the inner surface 111 of the first wall 110 so as to effect cooling of fourth and seventh portions 110D and 110G of the first wall 110 via convective heat transfer. In the illustrated embodiment, the fourth impingement bores 280 define a plurality of rows extending in the Y direction and along a substantial portion of the length L of the airfoil 20, see FIGS. 2B and 5.

It is contemplated that the first, second, third and fourth impingement passages and/or the first, second and third bleed passages may be defined by slots or openings of other shapes rather than bores as shown in the illustrated embodiment.

Figure 2A:
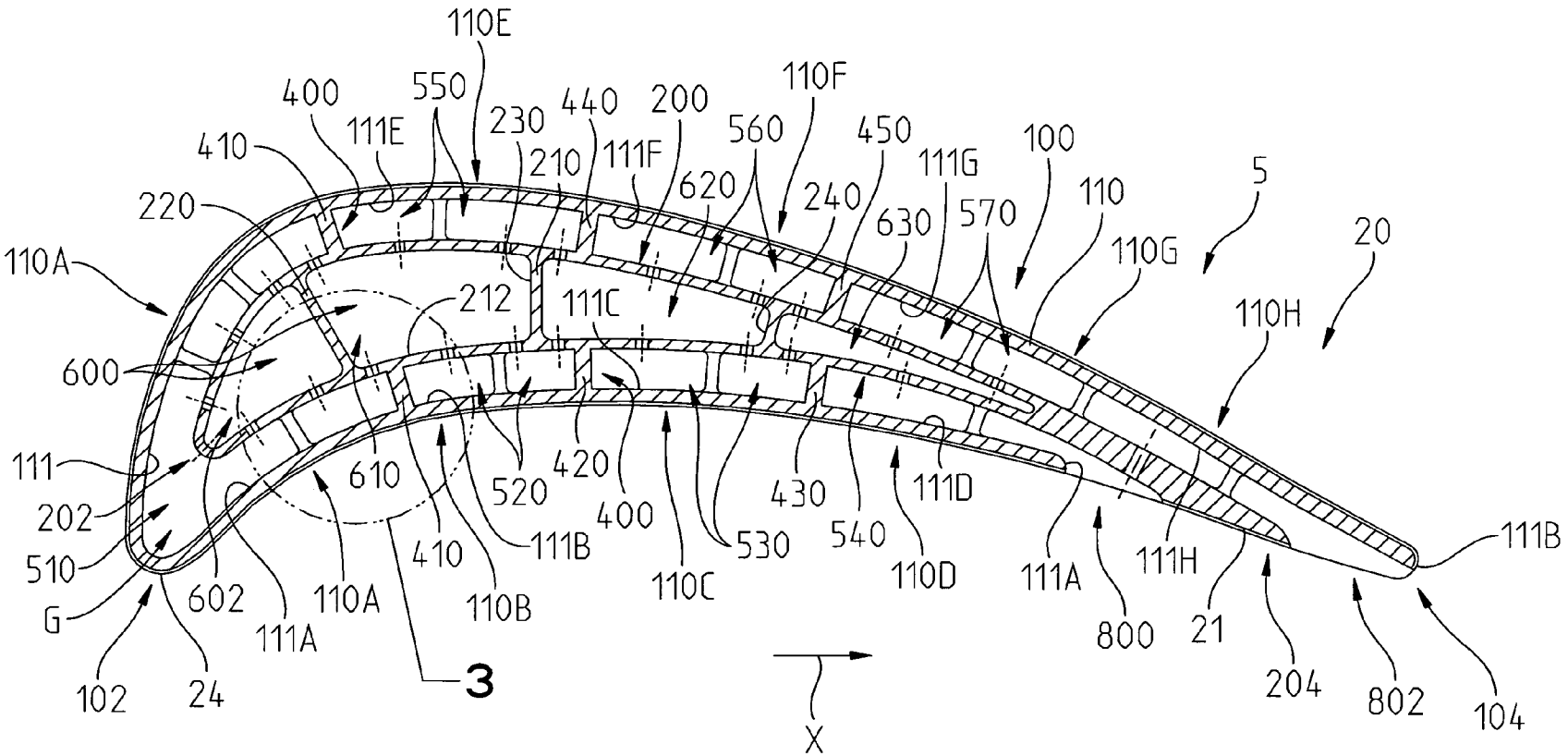
FIGS. 2A and 2B are cross sectional views taken along view line 2A,B-2A,B in FIG. 1 (two views through the same section line are provided to allow all reference numerals to be shown clearly)

The outer structure 100 has a first leading edge or end section 102 and a second trailing edge or end section 104, see FIGS. 2A and 4. The first wall 110 comprises first and second end edges 111A and 111B. The second end edge 111B of the first wall 110 may define the second trailing end section 104 of the outer structure 100 and the first end edge 111A of the first wall 110 may be positioned between the first and second end sections 102 and 104 of the outer structure 100.

The inner structure 200 may have first and second end sections 202 and 204, see FIGS. 2A and 4. A plurality of first exit passages, rectangular openings 800 in the illustrated embodiment, are defined by the first end edge 111A of the first wall 110, the second end section 204 of the inner structure 200 and first stiffener members 810 extending between the outer and inner structures 100 and 200, see FIGS. 1, 4 and 4A. A plurality of second exit passages, rectangular openings 802 in the illustrated embodiment, are defined by the second end edge 111B of the first wall 110, second stiffener members 812 extending between the outer and inner structures 100 and 200, see FIGS. 1, 4 and 4A, and the second end section 204 of the inner structure 200.

Cooling fluid in the fourth and seventh cooling fluid impingement gaps 540 and 570 exit those gaps as well as the airfoil 20 via the first and second exit openings 800 and 802.

Figure 2B:
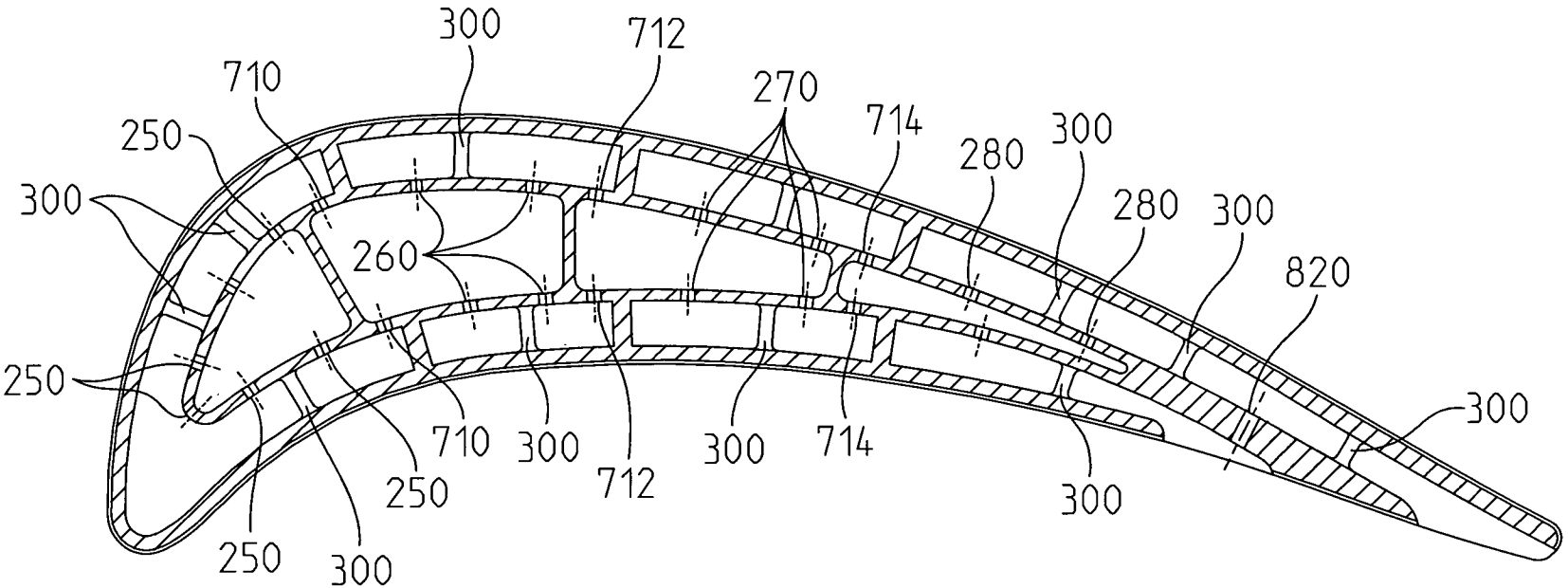

A plurality of trailing end impingement passages, bores 820 in the illustrated embodiment, extend through the second end section 204 of the inner structure 200, see FIGS. 2B and 5. As is apparent from FIG. 2B, the bores 820 are positioned near the first exit openings 800. In the illustrated embodiment, the bores 820 may define one or more rows extending in the Y direction and along a substantial portion of the length L of the airfoil 20. Due to the configuration of the airfoil 20, and the location of the bores 820, it is believe that a portion of the air passing through the fourth cooling fluid impingement gap 540 will be pulled via suction from the fourth cooling fluid impingement gap 540 through the bores 820 and into the seventh cooling fluid impingement gap 570. Hence, it is believed that jets of cooling fluid will pass through the bores 820 and impinge upon an eighth section 111H of the inner surface 111 of the first wall 110 so as to effect cooling of an eighth portion 110H of the first wall 110 via convective heat transfer. Also, the cooling fluid passing through the bores 820 is believed to cause the fluid passing out from the first exit openings 800 to be drawn against the outer surface 21/coating 24 of the first wall 110, thereby enhancing cooling of the airfoil 20.

The first and second exit openings 800 and 802 may have other shapes beyond the rectangular shapes shown in the illustrated embodiment.

In accordance with the present invention, an airfoil cooling system 5 is defined at least in part by the cooling fluid supply cavity 602, the first, second and third cooling fluid collector cavities 610, 620 and 630, the first, second, third, fourth, fifth, sixth, and seventh cooling fluid impingement gaps 510, 520, 530, 540, 550, 560 and 570, the first, second, third and fourth impingement bores 250, 260, 270, 280, the first, second and third bleed bores 710, 712, 714, the trailing end impingement bores 820 and the first and second exit openings 800 and 802.

Hence, a cooling fluid enters the cooling fluid supply cavity 602 and sequentially moves through the airfoil 10 as follows: passes from the supply cavity 602 into the first cooling fluid impingement gap 510, moves into the first cooling fluid collector cavity 610, passes into the second and fifth cooling fluid impingement gaps 520 and 550, moves into the second cooling fluid collector cavity 620, passes into the third and sixth cooling fluid impingement gaps 530 and 560, moves into the third cooling fluid collector cavity 630, passes into the fourth and seventh cooling fluid impingement gaps 540 and 570 and passes out of the airfoil through the exit openings 800 and 802.

It is believed that the airfoil cooling system 5 will function in a very efficient manner so as to allow the airfoil 20 to be used in high temperature applications where a cooling fluid is provided at a low flow rate to the cooling system 5.

Because the cooling requirements for the various portions 110A-110H of the first wall 110 may vary, it is contemplated that the distances between the second wall 210 and each portion 110A-110H of the first wall 110 may differ to allow for optimum cooling of the airfoil 20. For example, the distance between the second wall 210 and the portions 110D, 110G and 110H of the first wall 110 may be less than the distance between the second wall 210 and the portion 110A of the first wall 110 so as to accelerate the cooling fluid as it leaves the first and second exit openings 800 and 802, thereby enhancing cooling of the trailing end section 104 of the outer structure 100. Also, the size and/or number of: the cooling fluid supply cavity; the cooling fluid collector cavities; the cooling fluid impingement gaps; the impingement bores; the bleed bores; the trailing end impingement bores, and/or the first and second exit openings may be varied so as to achieve optimum cooling of all portions 110A-110H of the outer structure first wall 110.

Figure 3:
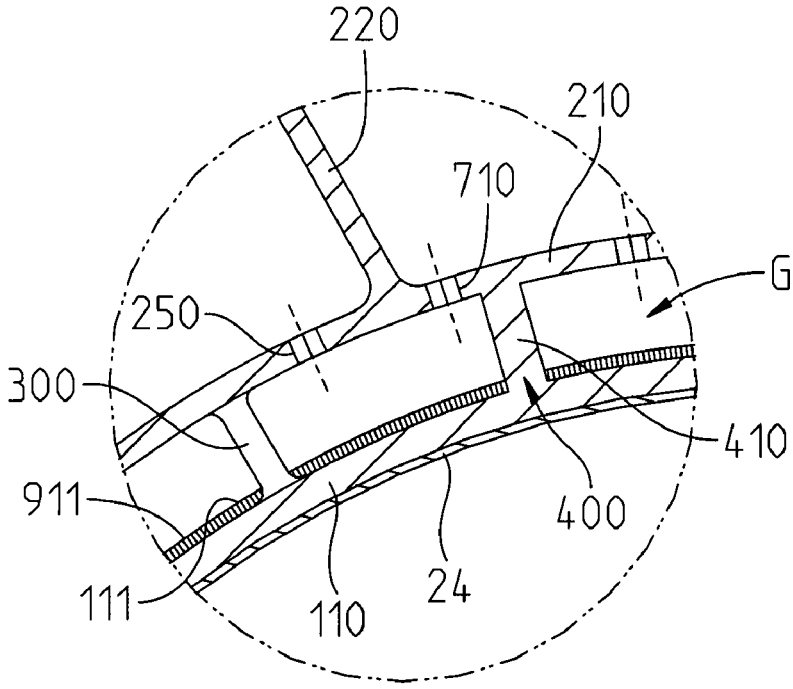
FIG. 3 is an enlarged view of a portion of the blade in FIG. 2.

In the illustrated embodiment, the inner surface 111 of the first wall 110 of the outer structure 100 may comprise a textured or rough surface 911, see FIG. 3. The textured surface 911 provides additional surface area on the inner surface 111 upon which the cooling fluid contacts, thereby increasing heat transfer from the first wall 110 to the cooling fluid. The textured surface 911 may be defined by small fins, pins, concaved dimples, and the like.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An airfoil for a gas turbine comprising:

an outer structure comprising a first wall;

an inner structure comprising a second wall spaced relative to said first wall such that a cooling gap is defined between at least portions of said first and second walls, an inner surface of said second wall defining an inner cavity, said inner structure further comprising a separating member for separating said inner cavity of said inner structure into a cooling fluid supply cavity and a cooling fluid collector cavity, said second wall comprising at least one first impingement passage, at least one second impingement passage, and at least one bleed passage; and seal structure provided within said cooling gap between said first and second walls for separating said cooling gap into first and second cooling fluid impingement gaps, said at least one first impingement passage extending from said cooling fluid supply cavity to said first cooling fluid impingement gap, said at least one bleed passage extending from said first cooling fluid impingement gap to said cooling fluid collector cavity, and said at least one second impingement passage extending from said cooling fluid collector cavity to said second cooling fluid impingement gap such that cooling fluid exits said collector cavity through said at least one second impingement passage and passes into said second cooling fluid impingement gap.

2. An airfoil as set out in claim 1, wherein said cooling fluid supply cavity being adapted to receive cooling fluid such that the cooling fluid passes from said cooling fluid supply cavity through said at least one first impingement passage into said first cooling fluid impingement gap so as to strike a first section of an inner surface of said first wall, the cooling fluid passes from said first cooling fluid impingement gap through said at least one bleed passage into said cooling fluid collector cavity, and the cooling fluid passes from said cooling fluid collector cavity through said at least one second impingement passage into said second cooling fluid impingement gap so as to strike a second section of said inner surface of said first wall.

3. An airfoil as set out in claim 1, wherein said separating member comprises a first separating member and said cooling fluid collector cavity comprises a first cooling fluid collector cavity and said inner structure further comprising a second separating member such that said first and second separating members separate said inner cavity of said inner structure into said cooling fluid supply cavity, said first cooling fluid collector cavity and a second cooling fluid collector cavity, wherein only a single cooling fluid supply cavity is provided.

4. An airfoil as set out in claim 3, wherein said seal structure comprises first seal structure, said at least one bleed passage comprises at least one first bleed passage and said second wall of said inner structure further comprises at least one third impingement passage and at least one second bleed passage.

5. An airfoil as set out in claim 4, wherein said seal structure further comprising second seal structure within said cooling gap between said first and second walls such that said first and second seal structures separate said cooling gap into first, second and third cooling fluid impingement gaps, said at least one second bleed passage extends between said second cooling fluid impingement gap to said second cooling fluid collector cavity and said at least one third impingement passage extends from said second cooling fluid collector cavity to said third cooling fluid impingement gap.

6. An airfoil as set out in claim 1, wherein a first distance between said first and second walls within first cooling fluid impingement gap differs from a second distance between said first and second walls within said second cooling fluid impingement gap.

7. An airfoil as set out in claim 1, wherein said at least one first impingement passage comprises a plurality of first impingement bores or at least one first impingement slot and said at least one second impingement passage comprises a plurality of second impingement bores or at least one second impingement slot.

8. An airfoil as set out in claim 1, further comprising a plurality of connectors extending between said first and second walls for coupling said first and second walls together.

9. An airfoil as set out in claim 1, wherein an inner surface of said first wall of said outer structure comprises a rough surface.

10. An airfoil as set out in claim 1, wherein said outer structure has first and second end sections, and said first wall has first and second end edges, said second end edge of said first wall defines said second end section of said outer structure and said first end edge of said first wall is positioned between said first and second end sections of said outer structure.

11. An airfoil as set out in claim 10, wherein said inner structure has first and second end sections, at least one first exit passage is defined at least in part by said first end edge of said first wall and said second end section of said inner structure, and at least one second exit passage is defined at least in part by said second end edge of said first wall and said second end section of said inner structure.

12. An airfoil as set out in claim 11, wherein said at least one first exit passage comprises a plurality of first exit bores or at least one first exit slot and said at least one second exit passage comprises a plurality of second exit bores or at least one second exit slot.

13. An airfoil as set out in claim 11, wherein said second end section of said inner structure is solid and comprises at least one impingement passage extending through said inner structure second end section and positioned near said at least one first exit passage.

14. A blade for a gas turbine comprising:

a root;

a platform coupled to said root; and an airfoil coupled to said platform, said airfoil comprising:

an outer structure comprising a first wall;

an inner structure comprising a second wall spaced relative to said first wall such that a cooling gap is defined between at least portions of said first and second walls, an inner surface of said second wall defining an inner cavity, said inner structure further comprising a separating member for separating said inner cavity of said inner structure into a cooling fluid supply cavity and a cooling fluid collector cavity, said second wall comprising at least one first impingement passage, at least one second impingement passage, and at least one bleed passage; and seal structure provided within said cooling gap between said first and second walls for separating said cooling gap into first and second cooling fluid impingement gaps, said at least one first impingement passage extending from said cooling fluid supply cavity to said first cooling fluid impingement gap, said at least one bleed passage extending from said first cooling fluid impingement gap to said cooling fluid collector cavity, and said at least one second impingement passage extending from said cooling fluid collector cavity to said second cooling fluid impingement gap such that cooling fluid exits said collector cavity through said at least one second impingement passage and passes into said second cooling fluid impingement gap.

15. The blade as set out in claim 14, wherein said cooling fluid supply cavity being adapted to receive cooling fluid such that the cooling fluid passes from said cooling fluid supply cavity through said at least one first impingement passage into said first cooling fluid impingement gap so as to strike a first section of an inner surface of said first wall, the cooling fluid passes from said first cooling fluid impingement gap through said at least one bleed passage into said cooling fluid collector cavity, and the cooling fluid passes from said cooling fluid collector cavity through said at least one second impingement passage into said second cooling fluid impingement gap so as to strike a second section of said inner surface of said first wall.

16. The blade as set out in claim 14, wherein said separating member comprises a first separating member and said cooling fluid collector cavity comprises a first cooling fluid collector cavity and said inner structure further comprising a second separating member such that said first and second separating members separate said inner cavity of said inner structure into said cooling fluid supply cavity, said first cooling fluid collector cavity and a second cooling fluid collector cavity, wherein only a single cooling fluid supply cavity is provided.

17. The blade as set out in claim 16, wherein said seal structure comprises first seal structure, said at least one bleed passage comprises at least one first bleed passage and said second wall of said inner structure further comprises at least one third impingement passage and at least one second bleed passage.

18. The blade as set out in claim 17, wherein said seal structure further comprising second seal structure within said cooling gap between said first and second walls such that said first and second seal structures separate said cooling gap into first, second and third cooling fluid impingement gaps, said at least one second bleed passage extends between said second cooling fluid impingement gap to said second cooling fluid collector cavity and said at least one third impingement passage extends from said second cooling fluid collector cavity to said third cooling fluid impingement gap.

19. The blade as set out in claim 14, wherein a first distance between said first and second walls within first cooling fluid impingement gap differs from a second distance between said first and second walls within said second cooling fluid impingement gap.

20. The blade as set out in claim 14, wherein said at least one first impingement passage comprises a plurality of first impingement bores or at least one first impingement slot and said at least one second impingement passage comprises a plurality of second impingement bores or at least one second impingement slot.

* * * * *